US009752737B2

(12) United States Patent
Skergeth et al.

(10) Patent No.: US 9,752,737 B2
(45) Date of Patent: Sep. 5, 2017

(54) LED LIGHTING MODULE AND LUMINAIRE COMPRISING AT LEAST ONE LED LIGHTING MODULE

(71) Applicant: ZUMTOBEL LIGHTING GMBH, Dornbirn (AT)

(72) Inventors: Sascha Skergeth, Lustenau (AT); Matthias Menke, Hard (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 87 days.

(21) Appl. No.: 14/773,499

(22) PCT Filed: Mar. 3, 2014

(86) PCT No.: PCT/EP2014/054061

§ 371 (c)(1),
(2) Date: Sep. 8, 2015

(87) PCT Pub. No.: WO2014/135492

PCT Pub. Date: Sep. 12, 2014

(65) Prior Publication Data

US 2016/0018063 A1 Jan. 21, 2016

(30) Foreign Application Priority Data

Mar. 7, 2013 (DE) ..... 10 2013 203 912

(51) Int. Cl.
*F21V 13/00* (2006.01)
*F21K 99/00* (2016.01)
(Continued)

(52) U.S. Cl.
CPC ..... *F21K 9/50* (2013.01); *F21K 9/60* (2016.08); *F21S 10/00* (2013.01); *F21V 3/0445* (2013.01);
(Continued)

(58) Field of Classification Search
CPC ... F21K 9/50; F21V 5/007; F21V 5/04; F21V 3/0445; F21V 29/70; F21V 13/12;
(Continued)

(56) References Cited

U.S. PATENT DOCUMENTS 6,657,393 B2 12/2003 Natsume
9,046,232 B2 6/2015 Melzner et al.
(Continued)

FOREIGN PATENT DOCUMENTS

DE 102007044566 3/2009
DE 102007053790 5/2009
(Continued)

OTHER PUBLICATIONS

International Search Report for PCT/EP2014/054061, English translation attached to original, Both completed by the European Patent Office on Apr. 25, 2014, All together 7 Pages.

*Primary Examiner* — Alexander Garlen
(74) *Attorney, Agent, or Firm* — Brooks Kushman P.C.

(57) ABSTRACT

An LED lighting module having a plurality of first LEDs for generating a first light, a first optical element for influencing the first light, wherein the first optical element is designed to influence the first light such that it is emitted in a concentrated manner by the LED lighting module in a direction, at least one second LED for generating a second light and a second optical element for influencing the second light, wherein the second optical element is designed to influence the second light such that it is emitted diffusely by the LED lighting module in the direction.

19 Claims, 16 Drawing Sheets

Figure 1:
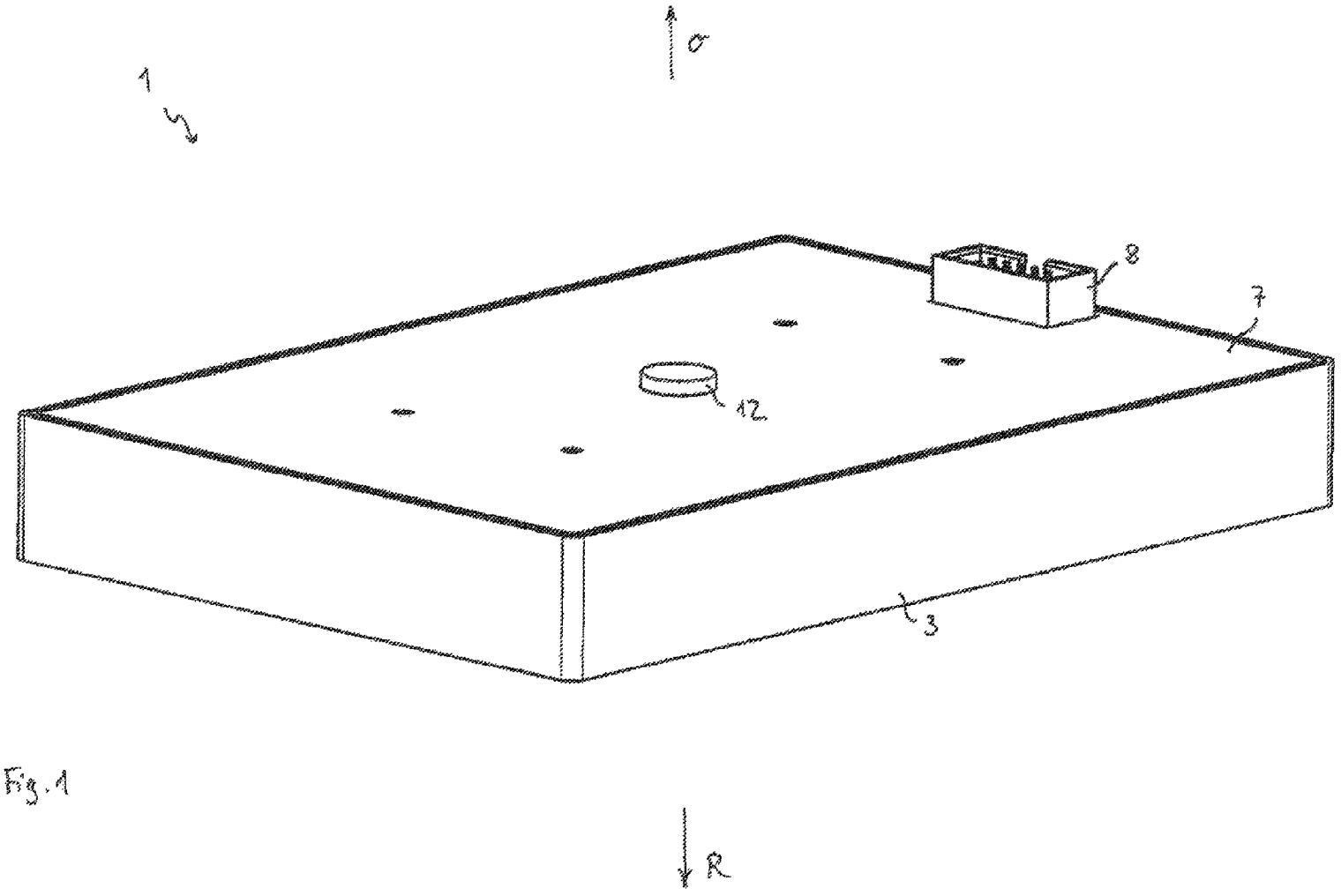

(51) Int. Cl.

| | |
|---|---|
| ***F21S 10/00*** | (2006.01) |
| ***F21V 5/00*** | (2015.01) |
| ***F21V 13/12*** | (2006.01) |
| ***F21V 23/04*** | (2006.01) |
| ***F21V 29/70*** | (2015.01) |
| ***F21V 3/04*** | (2006.01) |
| ***F21V 5/04*** | (2006.01) |
| ***F21K 9/60*** | (2016.01) |
| ***F21V 17/10*** | (2006.01) |
| *F21Y 105/10* | (2016.01) |
| *F21Y 115/10* | (2016.01) |

(52) U.S. Cl.
CPC ..... *F21V 5/007* (2013.01); *F21V 5/04* (2013.01); *F21V 13/12* (2013.01); *F21V 17/102* (2013.01); *F21V 23/04* (2013.01); *F21V 29/70* (2015.01); *F21Y 2105/10* (2016.08); *F21Y 2115/10* (2016.08)

(58) Field of Classification Search
CPC . F21V 23/04; F21S 10/00; F21S 8/043; F21S 8/063; F21Y 2105/001; F21Y 2101/02
See application file for complete search history.

(56) References Cited

U.S. PATENT DOCUMENTS

2002/0053878 A1* 5/2002 Masaki ..... B60Q 1/26 315/82
2008/0285271 A1* 11/2008 Roberge ..... F21S 8/033 362/235
2009/0196024 A1 8/2009 Heiking et al.
2010/0053046 A1 3/2010 Nakanishi
2010/0165618 A1 7/2010 Vissenberg et al.
2010/0238658 A1* 9/2010 Xiang ..... F21V 5/04 362/235
2010/0328939 A1 12/2010 Chen et al.
2011/0038150 A1* 2/2011 Woodgate ..... F21K 9/135 362/235
2011/0063857 A1 3/2011 Li et al.
2012/0319616 A1 12/2012 Quilici et al.
2013/0258662 A1* 10/2013 Treanton ..... F21S 2/005 362/235
2013/0293148 A1* 11/2013 Holland ..... F21V 5/04 315/297
2013/0335962 A1* 12/2013 Wu ..... F21V 5/004 362/235

FOREIGN PATENT DOCUMENTS

| | | |
|---|---|---|
| DE | 102010003805 | 10/2011 |
| DE | 102011107895 | 1/2013 |
| EP | 2397750 | 12/2011 |
| FR | 2814220 | 3/2002 |

* cited by examiner

Fig. 3
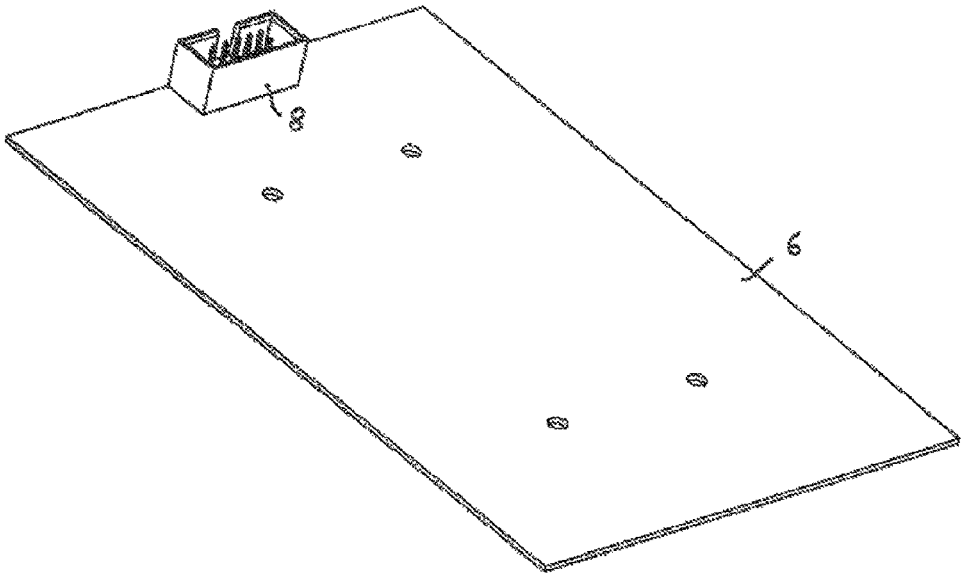
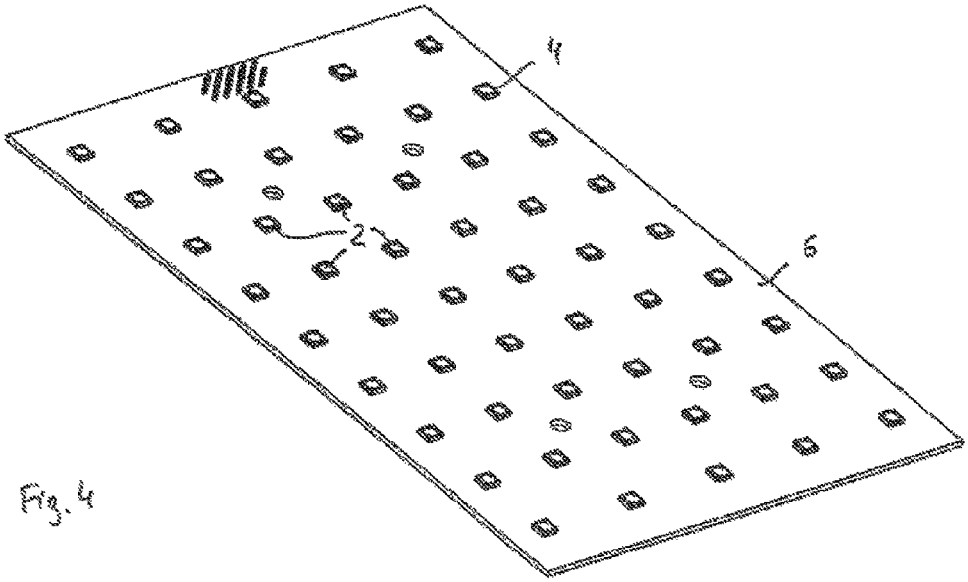
Fig. 4

Fig. 5
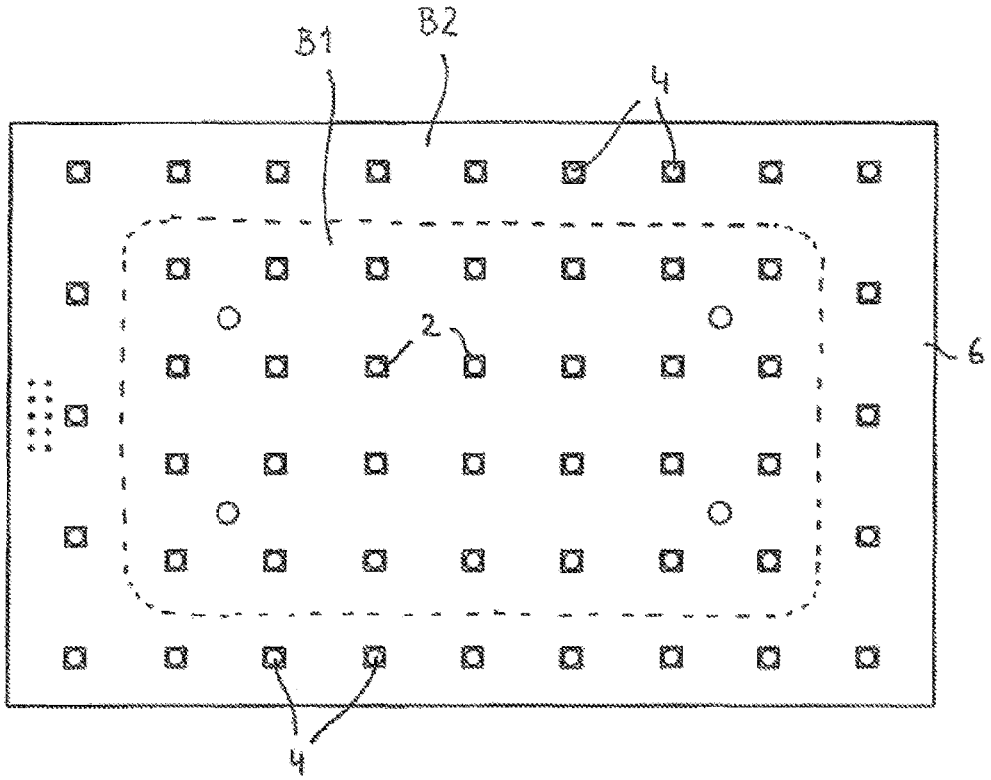
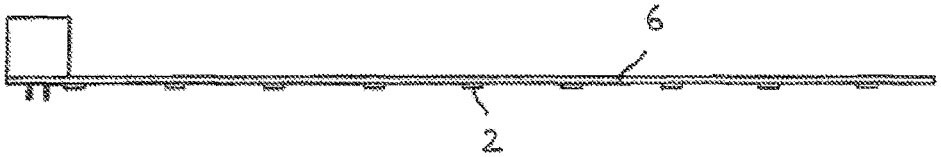
Fig. 6

Fig. 7
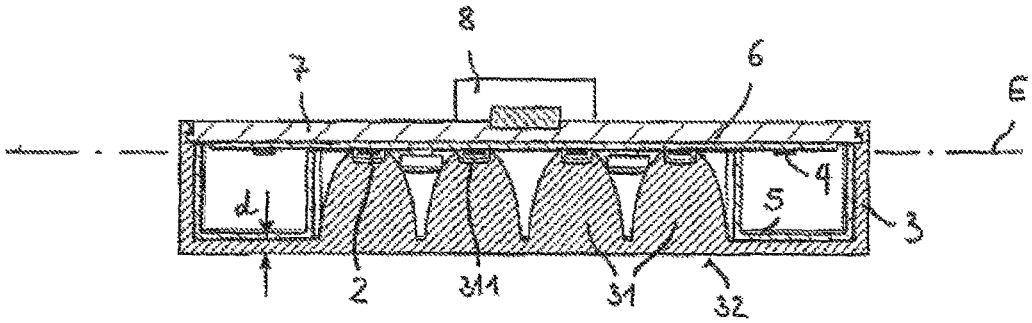
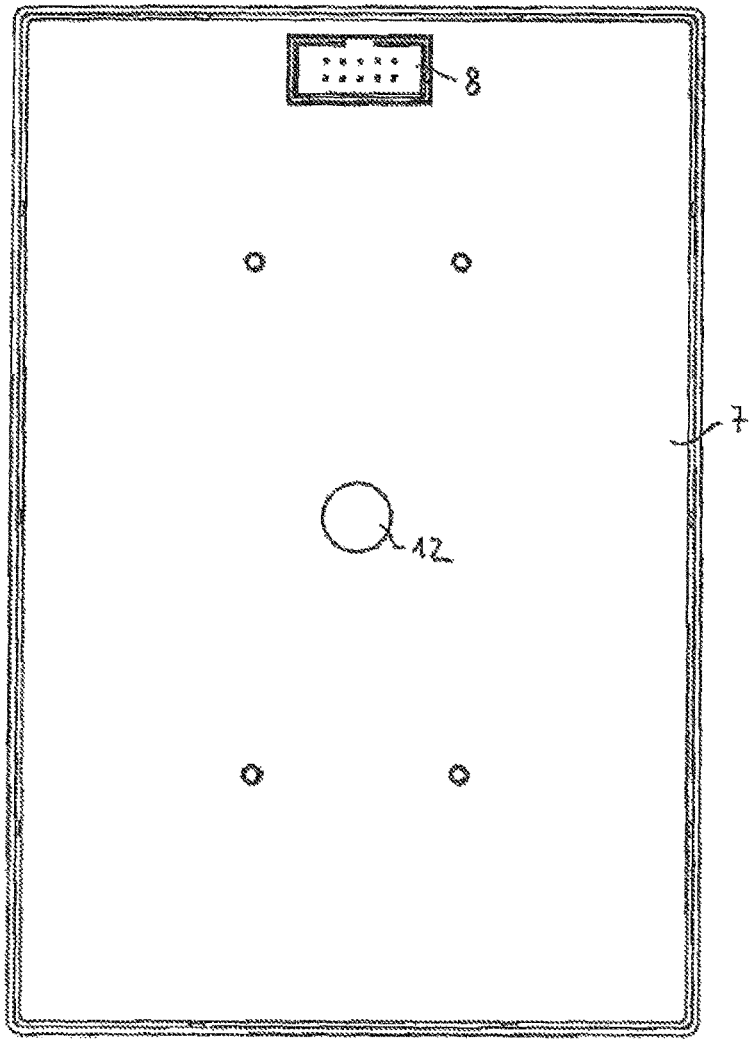
Fig. 8

LED LIGHTING MODULE AND LUMINAIRE COMPRISING AT LEAST ONE LED LIGHTING MODULE

CROSS-REFERENCE TO RELATED APPLICATION

This application is the U.S. national phase of PCT Application No. PCT/EP2014/054061 filed on Mar. 3, 2014, which claims priority to DE Patent Application No. 10 2013 203 912.3 filed on Mar. 7, 2013, the disclosures of which are incorporated in their entirety by reference herein.

The invention relates to an LED lighting module (LED: light-emitting diode) comprising a plurality of LEDs for generating light, and comprising an optical element for influencing the light. The invention furthermore concerns a luminaire comprising at least one such LED lighting module.

DE 10 2010 003 805 A1 discloses a corresponding arrangement for emitting light. The optical element in this case comprises lens regions, precisely one of the lens regions being assigned to each LED. The lens regions are used to collimate the light emitted by the LEDs.

In the known arrangement, it may happen that a nonuniform light appearance is formed on a surface which is illuminated with the arrangement. This is because precisely one lens element is assigned to each of the LEDs, so that a light beam is formed by each of the lens elements and the individual light beams formed in this way in effect do not merge fully with one another.

The object of the invention is to provide an improved LED lighting module. In particular, the LED lighting module is intended to allow particularly uniform illumination. The LED lighting module is furthermore intended to allow a simple structure as well as good thermal dissipation of the heat generated by the LEDs during operation. A further object is to provide a luminaire comprising such an LED lighting module.

These objects are achieved according to the invention by the subject-matter in the independent claims. Particular embodiments of the invention are specified in the dependent claims.

The invention provides an LED lighting module, which comprises a plurality of first LEDs for generating first light, as well as a first optical element for influencing the first light, the first optical element being configured in order to influence the first light in such a way that it is emitted collimated from the LED lighting module in a direction. The luminaire furthermore comprises at least one second LED for generating second light, as well as a second optical element for influencing the second light, the second optical element being configured in order to influence the second light in such a way that it is emitted diffusely from the LED lighting module in the direction.

The effect achievable by the diffuse light generated in this way is that the light beams generated by the first optical element are no longer perceived separately from one another as such. In this way, particularly homogeneous illumination can be achieved. In other words, by virtue of the at least one second LED and the second optical element, multiple shadows which are induced per se by the first light can be suppressed, or masked.

Preferably, the first LEDs and the at least one second LED are arranged in such a way that—as observed counter to the direction—the first LEDs are arranged in a central region and the at least one second LED is arranged in an outer region following on from the central region. In this way, the described effect can be achieved in a particularly suitable way.

To this end, furthermore, a plurality of second LEDs are preferably provided, at least two of the second LEDs being arranged on two opposite sides in relation to the central region. Particularly preferably, the LED lighting module comprises at least four second LEDs, in particular at least eight second LEDs.

One configuration which is particularly simple and at the same suitable in terms of production technology, is made possible when the first LEDs and/or the at least one second LED are arranged in the manner of a matrix, preferably arranged in the manner of a matrix on a printed circuit board.

Preferably, the first optical element comprises a plurality of lens elements, precisely one of the plurality of lens elements being assigned to each of the plurality of first LEDs.

A particularly compact configuration of the LED lighting module is made possible when the first optical element forms a first housing part of the LED lighting module.

Particularly suitable light emission by the LED lighting module is made possible when the first optical element is configured in order to influence the first light in such a way that it is emitted without glare from the LED lighting module.

It is advantageous in terms of production technology for the second optical element to consist of a plastic, in particular of an opal or colored plastic.

Preferably, the second optical element comprises a structured surface region, in particular a surface region structured in a wave-like manner. In this way, the second light generated by the at least one second LED can be influenced by the second optical element in such a way that, when the LED lighting module is observed counter to the direction, the second LEDs are essentially no longer discernible as such.

In particular, to this end the structured surface region may advantageously be configured in such a way that the second optical element has, in a subregion which is described by a projection of the at least one LED in the direction, a thickness which decreases from the subregion toward at least one side.

Particularly simple assembly of the LED lighting module is made possible when the second optical element is arranged inlaid in the first optical element.

Preferably, the LED lighting module furthermore comprises electronic components for operation of the first LEDs and of the at least one second LED.

Light emission which can be adjusted in a particularly versatile way is made possible when the first LEDs on the one hand, and the at least one second LED on the other hand, can be driven independently of one another.

Preferably, the first LEDs and/or the at least one second LED are arranged on a printed circuit board, the printed circuit board forming a second housing part of the LED lighting module. In this way, the LED lighting module can be constructed particularly simply; in addition, particularly simple assembly of the LED lighting module is made possible in this way. It is furthermore advantageous with a view to simple assembly that the configuration is such that the first optical element and the printed circuit board are connected to one another by means of a latch connection.

Particularly suitable removal of heat which is generated by the LEDs during operation of the LED lighting module is made possible when the LED lighting module furthermore comprises a metal plate, in particular an aluminum plate, the first LEDs and the at least one second LED being arranged thermally conductively connected to the metal plate. Preferably, the metal plate in this case forms a second housing part of the LED lighting module. Removal of the heat into an external region of the LED module is reinforced by means of this.

For a particularly suitable electrical connection between the first LEDs and the at least one second LED on the one hand, and a carrier element of a luminaire on the other hand, the LED lighting module furthermore preferably comprises a plug element. Particularly simple establishment of the electrical connection is made possible by means of this.

Another aspect of the invention provides a luminaire comprising at least one LED lighting module according to the invention. Preferably, the luminaire in this case furthermore comprises an operating device for the electricity supply of the at least one LED lighting module.

Figure 2:
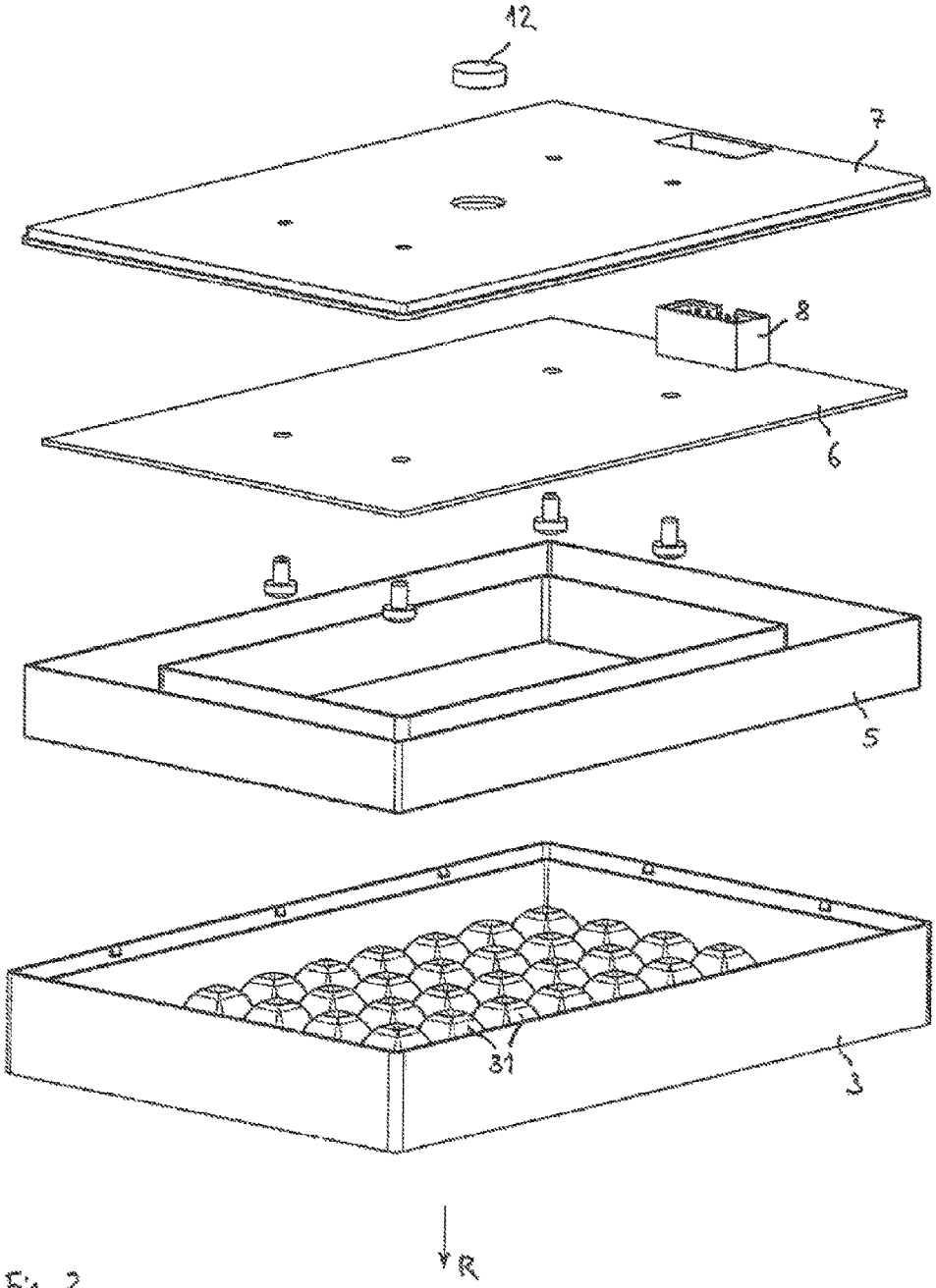
Figure 9:
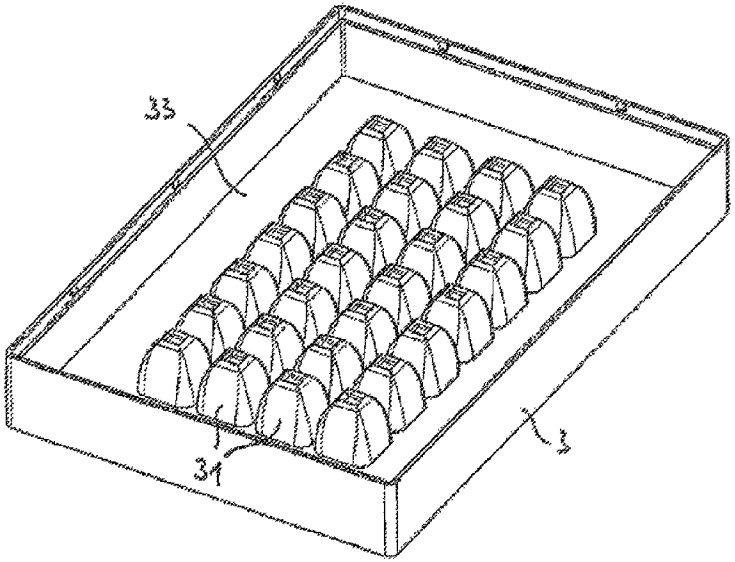
Figure 10:
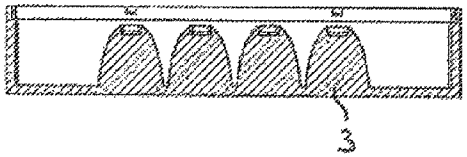
Figure 11:
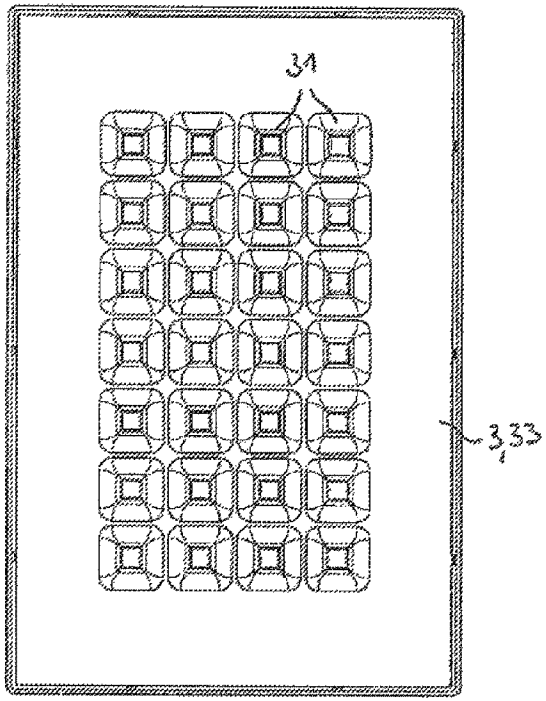
Figure 13:
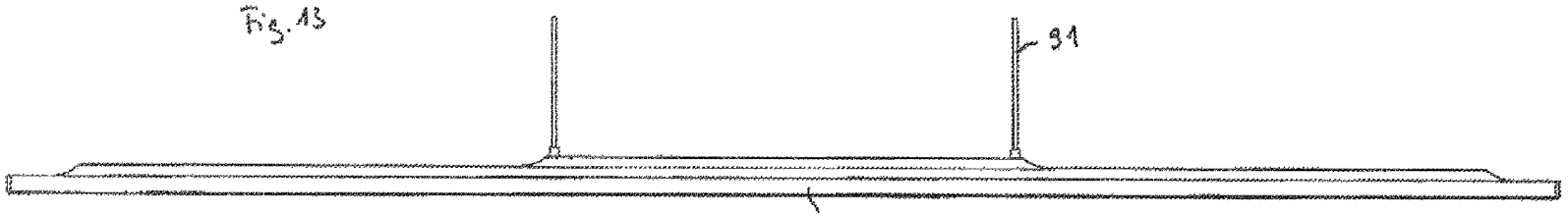
Figure 12:
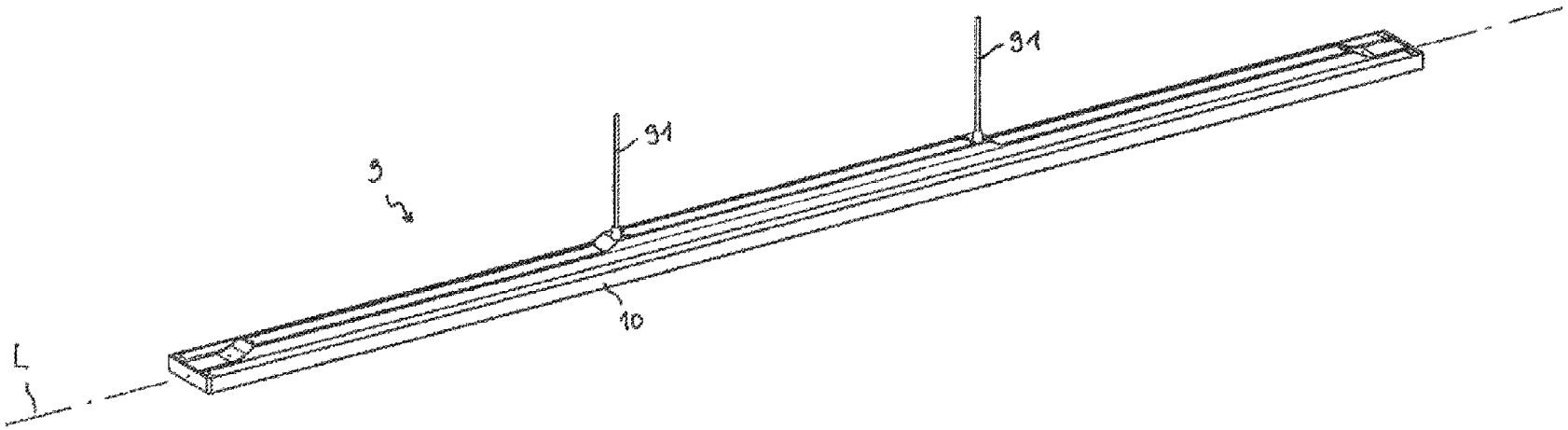
Figure 14:
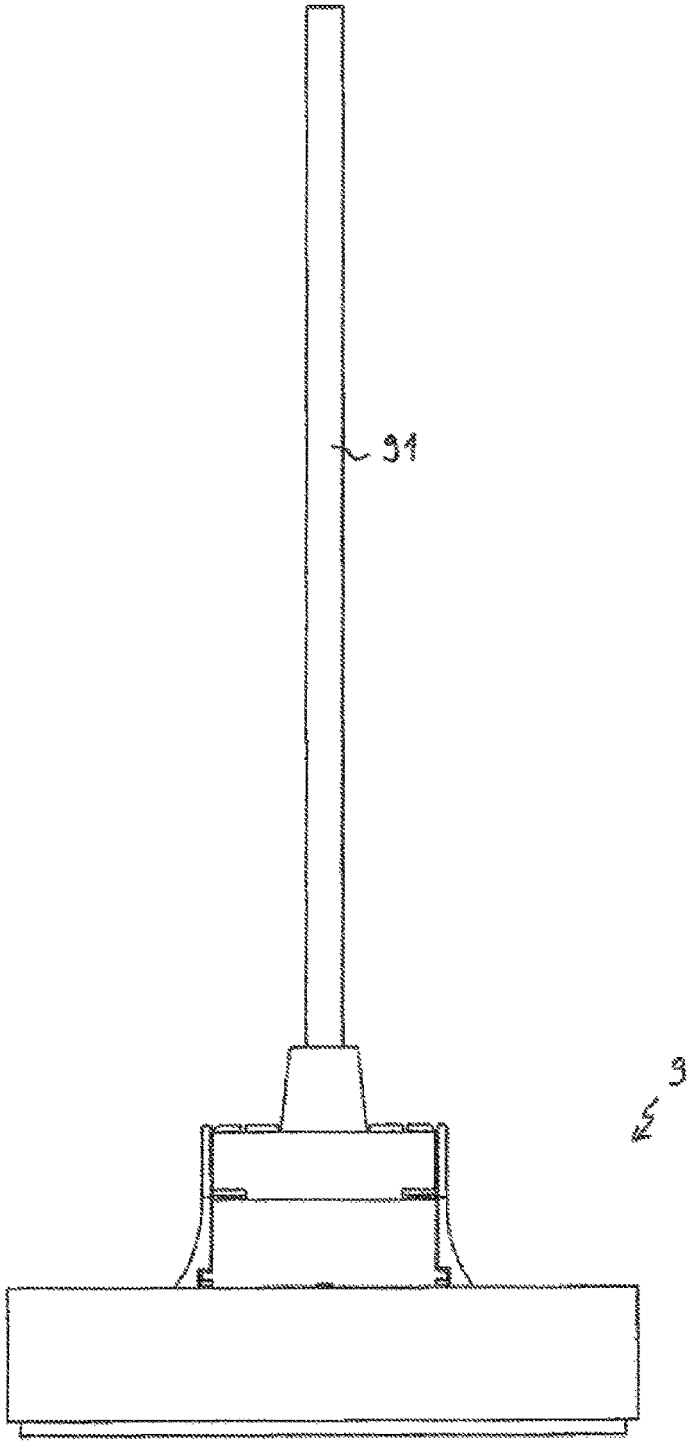
Figure 15:
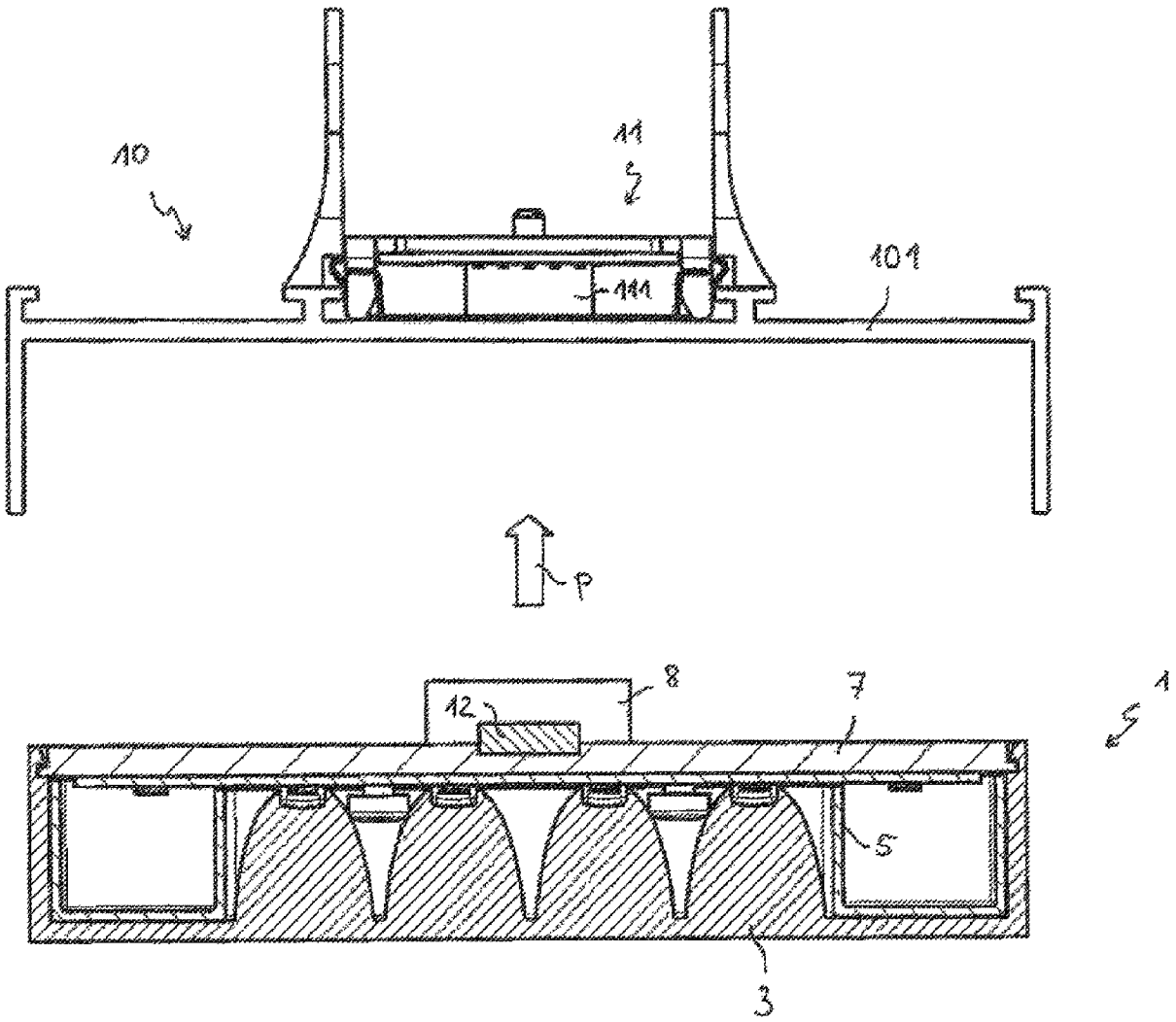
Figure 16:
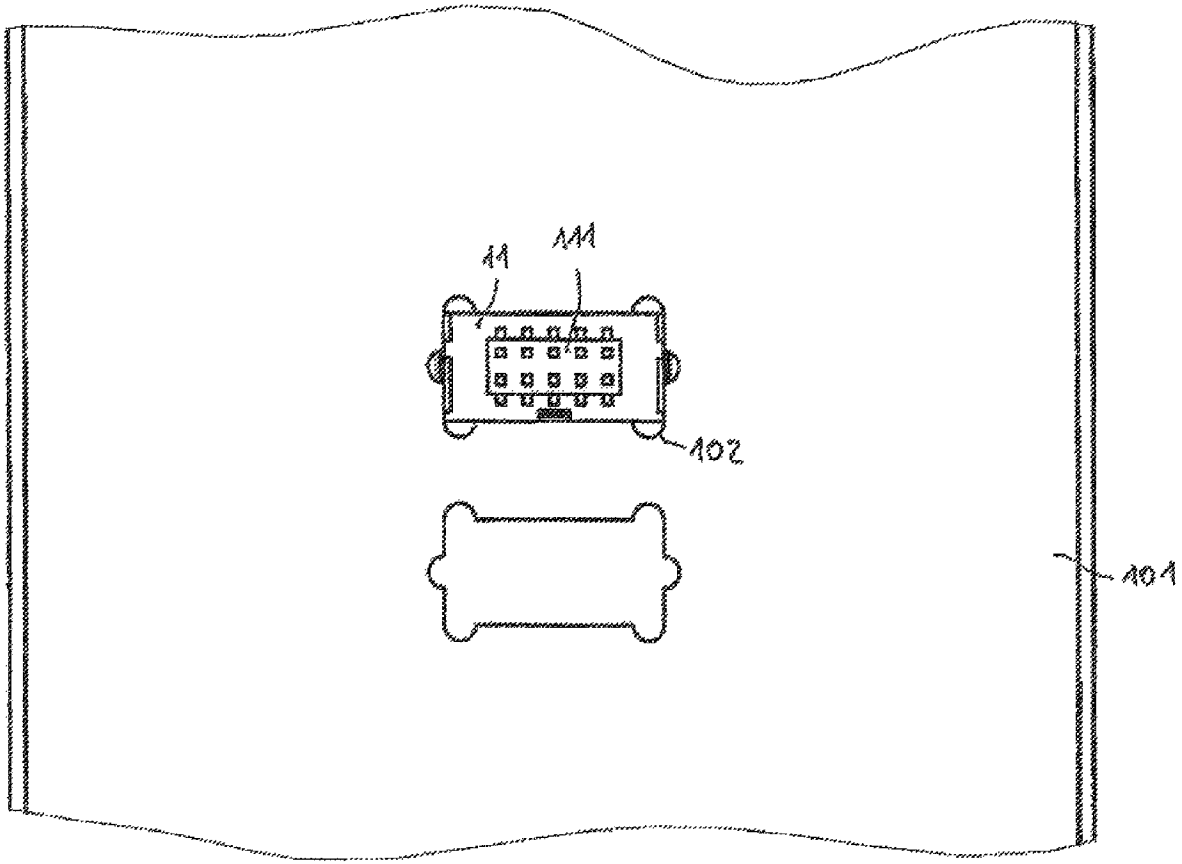
Figure 17:
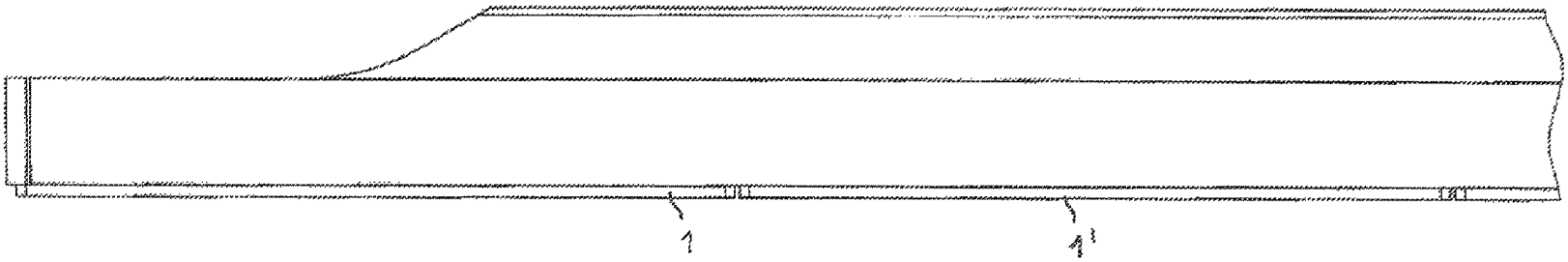
Figure 18:
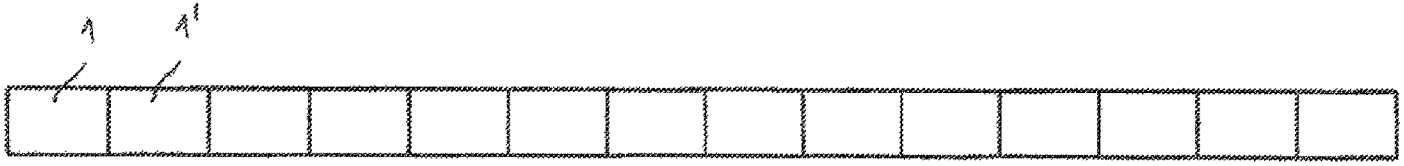
Figure 20:
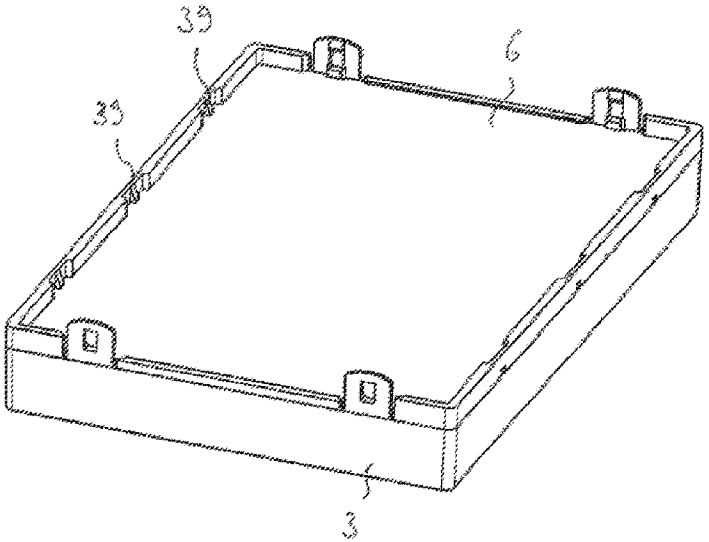
Figure 19:
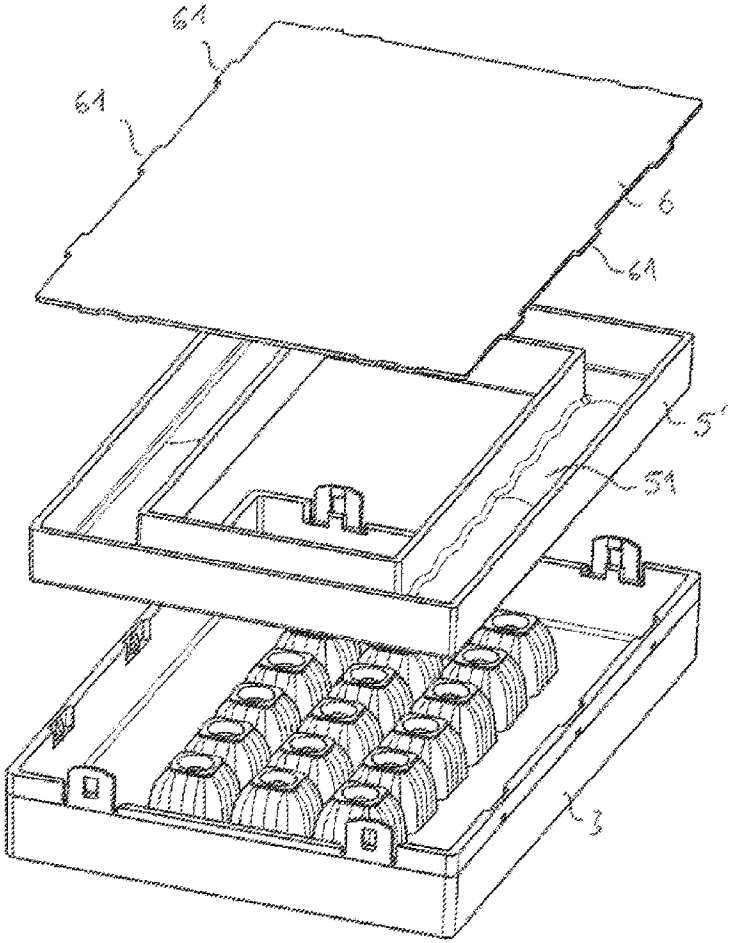
Figure 21:
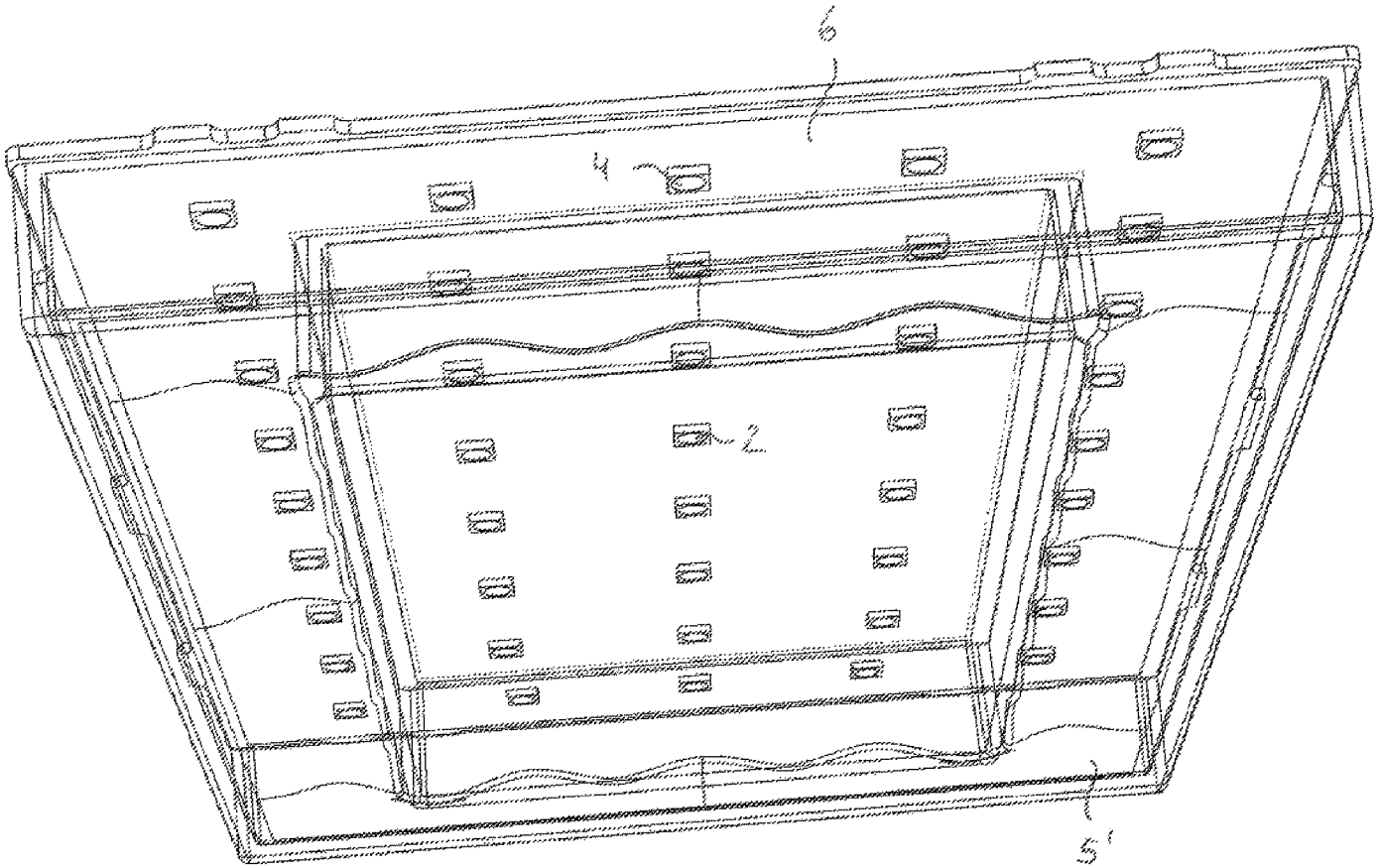
Figure 22:
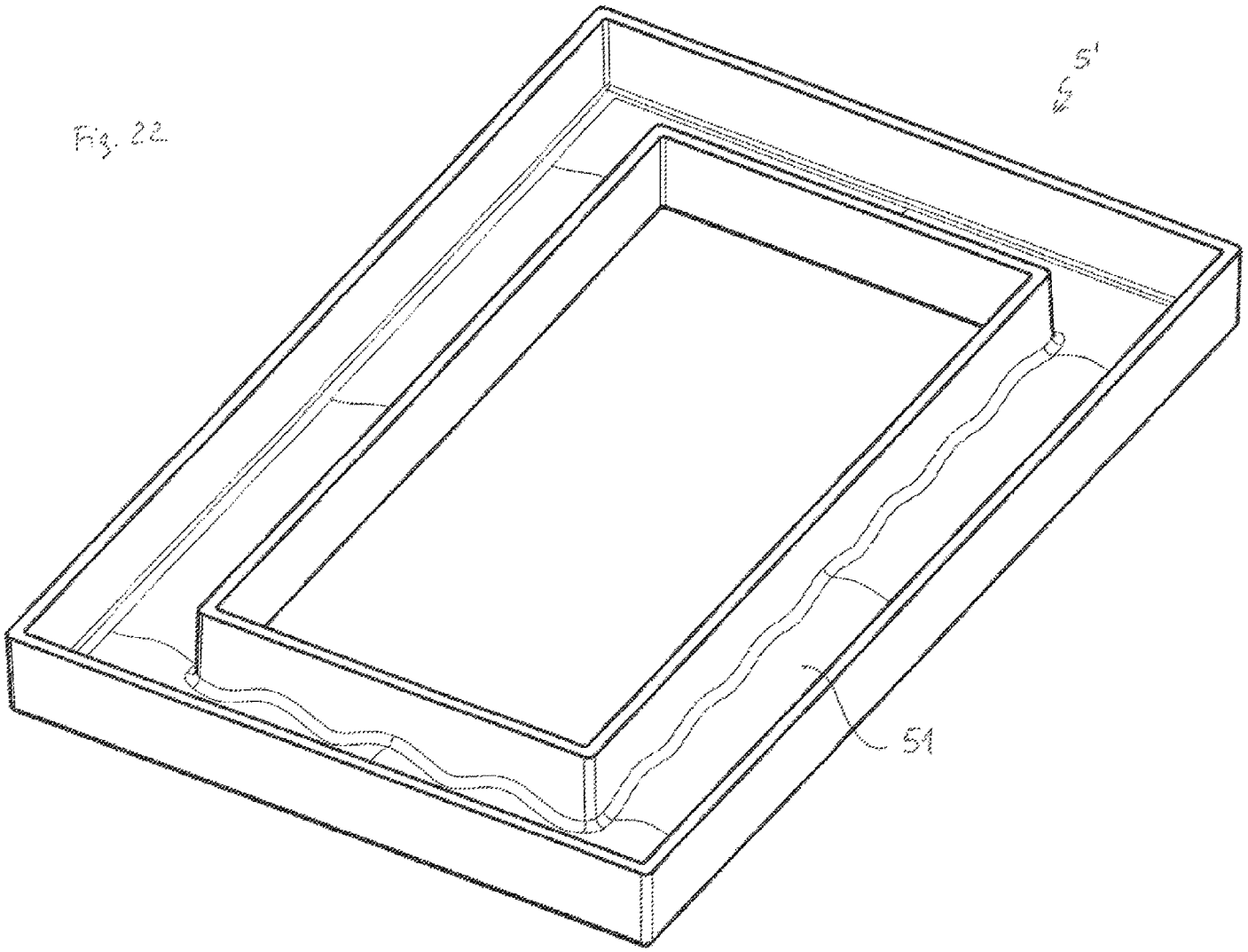
Figure 23:
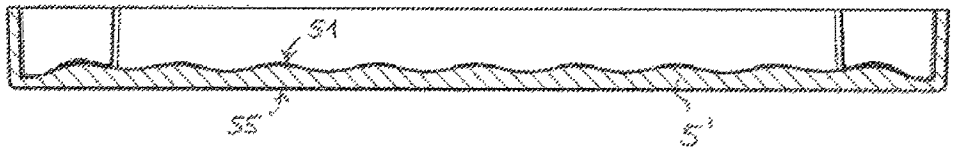
Figure 25:
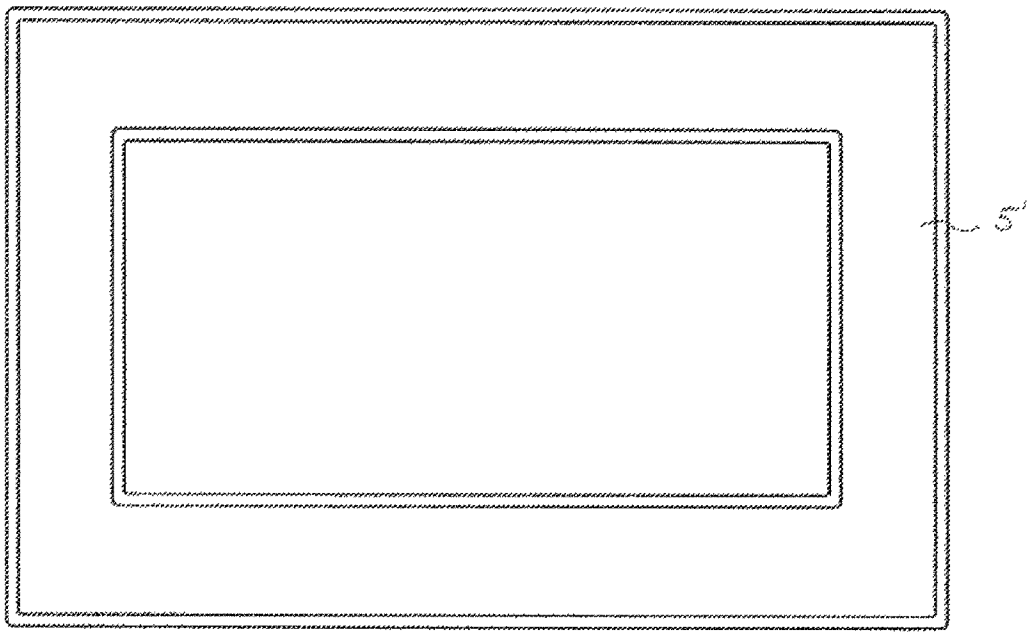
Figure 24:
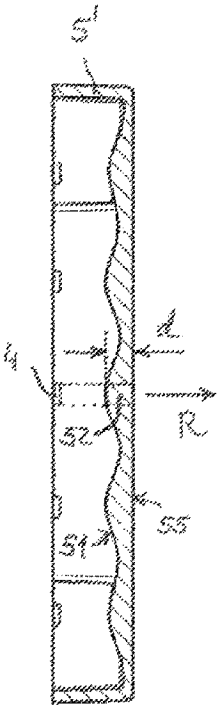
Figure 26:
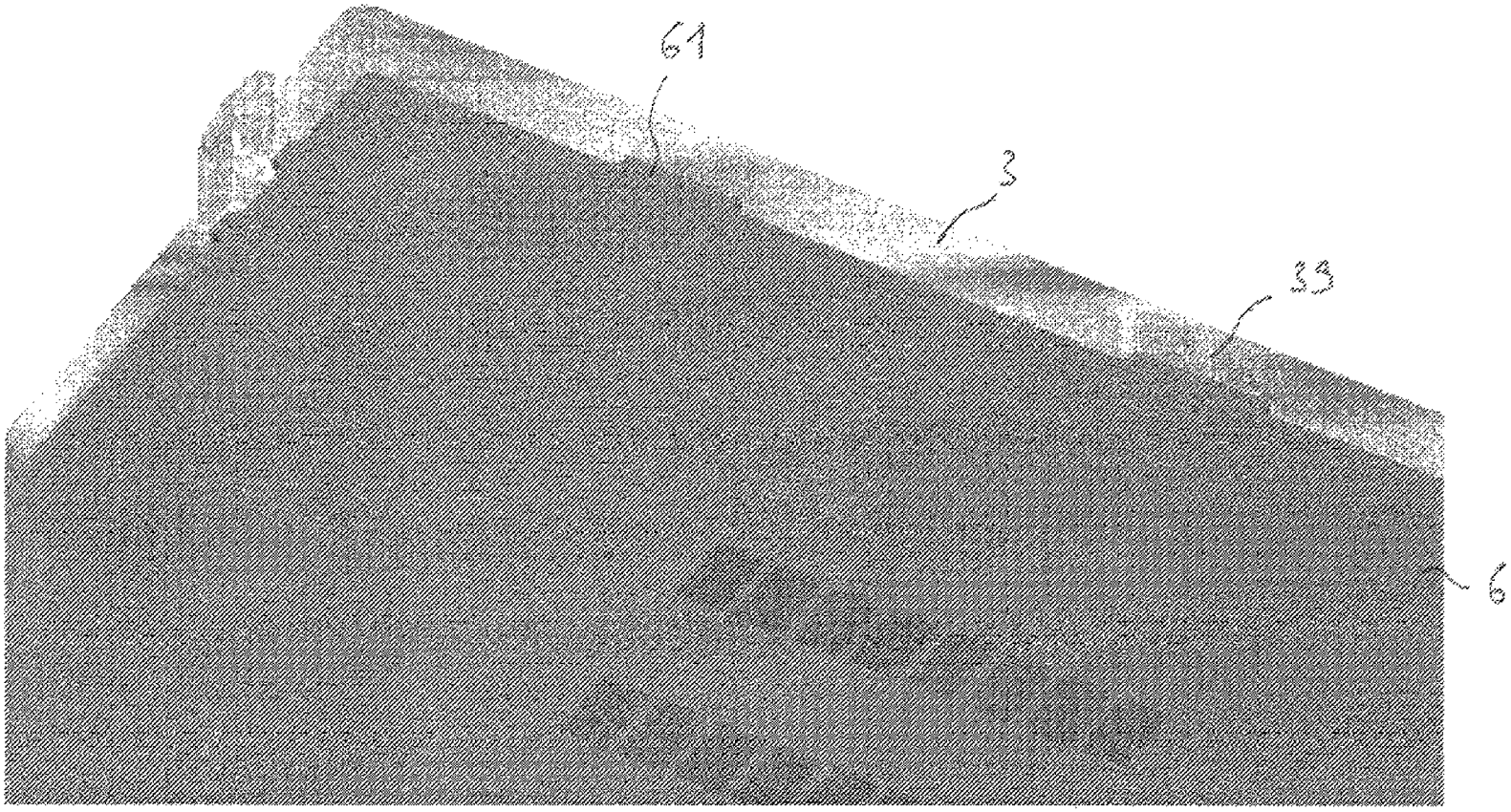

The invention will be explained in more detail below with the aid of an exemplary embodiment and with reference to the drawings, in which:

FIG. 1 shows a perspective view of an LED lighting module according to the invention, FIG. 2 shows a diagram of the LED lighting module in the manner of an exploded representation, FIG. 3 shows a perspective view of the LED printed circuit board of the LED lighting module obliquely from above, FIG. 4 shows a corresponding view obliquely from below, FIG. 5 shows a view of the LED printed circuit board from below, FIG. 6 shows a corresponding view from one side, FIG. 7 shows a cross-sectional diagram of the LED lighting module, FIG. 8 shows a view of the LED lighting module from above, FIG. 9 shows a perspective view of the first optical element of the LED lighting module obliquely from above, FIG. 10 shows a cross-sectional diagram of the first optical element, FIG. 11 shows a view of the first optical element from above, FIG. 12 shows a perspective view of a luminaire according to the invention obliquely from above, FIG. 13 shows a side view of the luminaire, FIG. 14 shows a front view of the luminaire, FIG. 15 shows a diagram of a cross section through the luminaire with the LED lighting module removed, FIG. 16 shows a view from below of a section of the carrier element of the luminaire, FIG. 17 shows a side view of an end region of the luminaire, FIG. 18 shows a schematic view of the luminaire from below, FIG. 19 shows a diagram of a variant of the LED lighting module in the manner of an exploded representation, FIG. 20 shows a perspective diagram of the LED lighting module according to the variant obliquely from above, FIG. 21 shows a transparent perspective view of the LED lighting module according to the variant obliquely from below, FIG. 22 shows a perspective view of the second optical element according to the variant, FIG. 23 shows a longitudinal-sectional representation, FIG. 24 shows a cross-sectional representation, FIG. 25 shows a plan view of the second optical element according to the variant, and FIG. 26 shows a perspective representation of the latch connection between the printed circuit board and the first optical element according to the variant.

FIG. 1 shows a perspective view of an LED lighting module 1 according to the invention obliquely from above. In the present description, it is assumed that the LED lighting module 1 is intended for light emission into the lower half-space, as indicated in FIG. 1 by an arrow R. The other arrow o correspondingly points vertically upward. This orientation of the LED lighting module 1 is preferred, but is not to be regarded as restrictive. The aforementioned orientation will be assumed below merely for the sake of a simpler description.

FIG. 2 shows a diagram of the LED lighting module 1 in the manner of an exploded representation. In the example shown, the LED lighting module 1 comprises a printed circuit board, or an LED printed circuit board 6. FIG. 3 shows the LED printed circuit board 6 in a separated form obliquely from above, FIG. 4 correspondingly obliquely from below and FIG. 6 from one side.

The LED lighting module 1 comprises a plurality of first LEDs 2, which are preferably arranged on the LED printed circuit board 6. The first LEDs 2 are configured in order to generate first light. Preferably, the first LEDs 2 are arranged in the manner of a matrix on the LED printed circuit board 6, in particular equidistantly.

As shown by way of example in FIG. 2, the LED lighting module 1 furthermore comprises a first optical element 3, which is configured in order to optically influence the first light in such a way that the first light is emitted collimated from the LED lighting module 1 in the direction R, or in a solid angle around the direction R.

To this end, the first optical element 3 preferably comprises lens elements 31, and is preferably configured in such a way that precisely one of the lens elements 31 is assigned to each of the first LEDs 2.

FIG. 7 shows a cross-sectional diagram of the LED lighting module 1. As indicated in this representation, the configuration is preferably such that the first LEDs 2 are arranged continuously in a plane E. This can be achieved straightforwardly when the LED printed circuit board 6 is configured to be planar.

As is furthermore indicated in FIG. 7, the configuration is preferably such that the lens elements 31 of the first optical element 3 extend upward as far as the plane E. The lens elements 31 may respectively comprise indentations 311 at the upper end region, the first LEDs 2 being arranged engaging therein. Furthermore, the lens elements 31 may have an approximately frustopyramidal shape widening downward.

In the example shown, the optical element 3 comprises a light emission surface 32, configured to be planar and which forms a light emission surface of the LED lighting module 1, the lens elements 31 preferably being configured extending to the light emission surface 32 to within a wall thickness d of the optical element 3. The lens elements 31 and the rest of the first optical element 3 may, in particular, be configured in one piece.

The configuration is furthermore preferably such that the first light emitted by the first LEDs 2 is optically influenced only by the lens elements 31, i.e. no other optical influencing elements are provided for the first light.

Preferably, the first optical element 3 is furthermore configured in order to influence the first light in such a way that it is emitted without glare from the LED lighting module 1. This can be achieved by suitable selection of the geometrical properties of the lens elements 31.

As shown in the figures, the lens elements 31 may be configured symmetrically. As an alternative, for example, provision may be made for the lens elements to be configured in such a way that—in relation to the vertical—they respectively lead to asymmetric light emission; if these lens elements are arranged mirror-symmetrically with respect to one another, overall observed symmetrical light emission may again be achieved.

As an alternative to the lens elements 31, for example, in order to influence the first light the first optical element may be provided with a prism structure.

As shown by FIGS. 2 and 7, the LED lighting module 1 is preferably configured in such a way that the first optical element 3 forms a first housing part of the LED lighting module 1.

FIG. 9 shows a view of the separated first optical element 3 in a diagram obliquely from above, FIG. 10 shows a cross-sectional diagram of the first optical element 3 and FIG. 11 shows a corresponding view from above.

The LED lighting module 1 furthermore comprises at least one second LED 4 for generating second light, as well as a second optical element 5 for influencing the second light. The at least one second LED 4 is preferably likewise arranged on the LED printed circuit board 6, specifically on the same side as the first LEDs 2.

The second optical element 5 is in this case configured in order to influence the second light in such a way that it is emitted diffusely from the LED lighting module 1 in the direction R, or in a solid angle around the direction R.

The effect achievable by the emission of the diffuse second light is that inhomogeneities of the directionally emitted first light on a surface illuminated by the LED lighting module 1 are reduced or entirely suppressed, so that they are no longer perceptible as such. Particularly uniform illumination can therefore be achieved with the LED lighting module 1.

FIG. 5 shows a view of the LED printed circuit board 6 from below, so that the first LEDs 2 arranged thereon and the at least one second LED 4 can be seen. As indicated in this representation, for particularly suitable achievement of the aforementioned effect the arrangement of the first LEDs 2 and of the at least one second LED 4 is preferably such that—as observed counter to the direction R—the first LEDs 2 are arranged in a central region B1 and the at least one second LED 4 is arranged in an outer region B2 following on externally from the central region B1. Accordingly, the central region B1 may be a central region of the LED printed circuit board 6 and the outer region B2 can be an outer region, or edge region, of the LED printed circuit board 6. Diffuse light emission in the edge region of the LED module 1 can thus be generated with the at least one second LED 4.

As shown in FIG. 5, the outer region B2 preferably extends continuously in a ring around the central region B1. Advantageously, the LED lighting module 1 is configured in such a way that no further light emission is provided externally around the outer region B2, i.e. so to speak the outer region B2 also forms an outer region of the LED lighting module 1.

Preferably, a plurality of second LEDs 4 are provided, at least two of the second LEDs 4 being arranged on two opposite sides in relation to the central region B1. In particular, the LED lighting module 1 preferably comprises at least four second LEDs 4, and particularly preferably at least eight second LEDs 4. A particularly suitable effect can be achieved when the second LEDs 4 are arranged in such a way that they are arranged extending on all sides in a uniform way around the central region B1. For example, the second LEDs 6 may also be arranged in the manner of a matrix on the LED printed circuit board 6. In the case of a rectangular LED printed circuit board 6, for example, provision may be made to arrange at least two, in particular at least three second LEDs 4 on each of the correspondingly formed four sides.

In the example shown, the LED printed circuit board 6 is rectangularly shaped and a total of twenty-four second LEDs 4 are arranged on it. In this case, twenty-eight first LEDs 2 are provided. The following—formulated generally—preferably applies for the ratio between the number $n_2$ of second LEDs 4 and the number $n_1$ of first LEDs 2:

$$\tfrac{1}{2}n_1 < n_2 < 2n_1.$$

The second optical element 5 preferably consists of an optically transmissive but diffusely acting plastic, in particular of an opal or colored plastic.

As shown by FIG. 2, the configuration is furthermore preferably such that the second optical element 5 is arranged inlaid in the first optical element 3. In the example shown, the second optical element 5 has the shape of a channel extending continuously around in a ring, which in particular has a U-shaped cross section.

As shown by FIG. 7, the second LEDs 4 are preferably likewise arranged in such a way that they pass through the plane E. The second optical element 5 preferably extends upward as far as this plane E, the side walls of the channel enclosing the at least one second LED 4 on both sides. The at least one second LED 4 is therefore used for backlighting of an opal-diffuse surface of the second optical element 5.

In the example shown, the first optical element 3 is shaped in such a way that it approximately defines a cuboid shape with its outer surfaces, the lens elements 31 being formed in a central region of the bottom or base surface of the cuboid. In other words, the first optical element 3 is preferably essentially pot-shaped, the lens elements 31 being formed in a central region of the bottom of the pot shape. As shown in particular by way of example by FIGS. 9 and 11, extending around the centrally arranged lens elements 31 at the bottom of the pot shape, a planar support surface 33 for supporting the second optical element 5 is formed by the first optical element 3.

As described, the first optical element 3 and the second optical element 5 thus may be formed consisting of two pieces. As an alternative, the two optical elements 3, 5 may also be produced, for example, integrally in a two-component injection molding method.

FIGS. 19 to 26 represent a variant of the LED lighting module. The references are used in a similar way. Unless otherwise described, the comments above also apply for this variant.

FIG. 19 shows a diagram of the variant in the manner of an exploded representation, and FIG. 20 shows a perspective diagram of the module in the assembled state obliquely from above. It can be seen that, in contrast to the embodiment described first, the second optical element, denoted here by 5', comprises a structured surface region 51 in particular a surface region 51 structured in a wave-like manner.

In this case, the second optical element 5', to the extent mentioned, may be configured in the form of a channel extending continuously around in a ring with a U-shaped cross section, but with the bottom of the channel not being shaped in a planar fashion here, but instead comprising the structured surface region 51, or with the structured surface region 51 forming the bottom of the channel.

FIG. 21 outlines a transparent perspective view of the LED lighting module according to the variant obliquely from below, and FIG. 22 shows a perspective view of the second optical element 5' obliquely from above; here, the surface region 51 which forms the wave-structured channel bottom, can be seen even more clearly.

FIGS. 23 and 24 show a longitudinal- and a cross-sectional representation, and FIG. 25 shows a plan view of the second optical element 5' according to the variant. FIG. 24 in this case also outlines the at least one second LED 4.

As shown in particular by the sectional representations of FIGS. 23 and 24, the structured surface region 51 is preferably configured in such a way that the second optical element 5' according to the variant comprises a bottom of the channel, which has different thicknesses at different positions. In particular, in this case the lower side of the channel, i.e. the outer surface 55 facing in the direction R, or the outer surface, lying opposite the structured surface region 51, of the second optical element 5' may be configured to be planar. In this way, the influencing of the second light when it passes through the channel bottom can be made particularly controlled and further improved diffuse light emission can thus be induced. The planar outer surface 55 is in this case used for bearing on the planar support surface 33 of the first optical element 3.

In particular, the effect achievable by the structured surface region 51 is that the second light is influenced in such a way that, when observing the LED module counter to the direction R, the at least one second LED 4 is almost no longer discernible as such, or a corresponding light point nevertheless appears at least significantly reduced.

In the variant shown, the structured surface region 51 is furthermore preferably configured in such a way that the second optical element 5' has, in a subregion 52 which—as indicated in FIG. 24—is described by a projection of the at least one second LED 4 in the direction R, a thickness d which decreases from the subregion 52 toward at least one side. In this way, the light which is emitted by the at least one second LED 4 in the direction R, i.e. in the direction in which the intensity generally has a maximum, must travel an increased distance through the second optical element 5'.

In other words, the bottom of the channel may comprise elevations or "hillocks" or wave crests, such that one of the second LEDs 4 is assigned to each of these elevations.

In the case of a wave structure, the wave shape of the channel bottom may, in particular, be configured in such a way that wave crests extend outward relative to the ring shape of the channel, the height of the wave crests preferably respectively decreasing outward.

Furthermore, in the configuration according to the variant, provision is made for the printed circuit board 6 to form a second housing part of the LED lighting module. Preferably, a housing, closed on all sides, of the module is in this case formed by the first housing part in the form of the first optical element 3 and the second housing part in the form of the printed circuit board 6. In order to allow particularly simple assembly of the module, the printed circuit board 6 may be connected to the first optical element 3 by a latch connection. In the exemplary embodiment shown, to this end the printed circuit board 6—as can be seen from FIGS. 19 and 26—comprises lateral projections 61 which engage under latching lugs 39 that are formed for this purpose on the first optical element 3.

Again with reference to the embodiment shown in FIGS. 1 to 18, the LED lighting module 1 furthermore preferably comprises a metal plate 7, particularly in the form of an aluminum plate. The first LEDs 2 and the at least one second LED 4 are in this case thermally conductively connected to the metal plate 7. In particular, the LED printed circuit board 6 may be arranged on a lower side of the metal plate 7, or fastened thereon, as shown by way of indication by FIG. 7. Particularly effective removal of heat which is generated by the LEDs during operation of the LED lighting module 1 can be made possible by the metal plate 7. The metal plate 7 is thus preferably configured as a carrier and heat sink of the LED printed circuit board 6.

Preferably, the metal plate 7 forms a second housing part of the LED lighting module 1, in particular a cover element. In this case, the configuration is furthermore preferably such that the metal plate 7 is arranged immediately adjacent to the first optical element 3, as likewise shown by way of example in particular by FIG. 7.

The LED lighting module 1 furthermore preferably comprises a plug element 8 for electrical connection between the first LEDs 2 and the at least one second LED 4 on the one hand, and a carrier element of a luminaire on the other hand, the plug element 8 preferably being arranged projecting above the metal plate 7. As indicated in FIG. 2, the plug element 8 is preferably arranged directly on the LED printed circuit board 6. The aforementioned electrical connection is preferably provided for an electricity supply of the LED lighting module 1 and/or for transmission of control signals to the LED lighting module 1.

FIG. 12 outlines a perspective view obliquely from above of a corresponding luminaire 9 according to the invention, FIG. 13 shows a side view of the luminaire 9, and FIG. 14 shows a front view of the luminaire. In the example shown, the luminaire is a hanging luminaire, which is intended to be suspended for operation from suspension elements 91, for example hanging tubes, chains or the like. The luminaire 10 is elongate overall in the example shown, so that it extends along a longitudinal axis L.

The luminaire 9 comprises a carrier element 10, which may in particular form a base body of the luminaire, or a luminaire base. FIG. 15 shows a cross section normal to the longitudinal axis L through the carrier element 10 when the LED lighting module 1 is removed. Starting from the situation outlined in FIG. 15, the LED lighting module 1 can be connected to the carrier element 10 by a movement upward against the carrier element 10 as indicated by a thick arrow P. The luminaire is configured in such a way that the LED lighting module 1 is both held mechanically on the carrier element 10 and is electrically connected to a contacting element 11, which is arranged mounted on the carrier element 10.

For the electrical connection between the LED lighting module 1 and the contacting element 11, a plug connection may in particular be provided. To this end, the contacting element 11 may comprise a socket 111, into which the plug element 8 of the LED lighting module 1 is inserted.

In the example shown, the carrier element 10 of luminaire 9 is configured as a profiled section, comprising a horizontal branch 101 and—in the state connected ready for operation—the metal plate 7 of the LED lighting module 1 contacts the horizontal branch 101 in a planar fashion from below. In this way, a particularly good thermal dissipation is made possible. The contacting element 11 is advantageously at least predominantly arranged above the horizontal branch 101 of the carrier element 10.

FIG. 16 shows a view from below of a section of the carrier element 10, and in particular the horizontal branch 101. The latter preferably comprises a through-opening 102, through which the electrical connection between the LED lighting module 1 and the contacting element 11 extends. To this end, the socket 111 is preferably arranged in such a way that it extends from above into the through-opening 102.

For the mechanical connection to the carrier element 10 of the luminaire 9, the LED lighting module 1 preferably comprises a holding element, for example in the form of a magnet 12. In the example shown, the magnet 12 is arranged on the upper side of the metal plate 7 in such a way that it extends projecting upward out beyond the metal plate 11. Preferably, at the correspondingly matching position of the carrier element 10, i.e. in particular on the horizontal branch 101, a corresponding recess (not shown in the figures) is provided, in which the magnet 12 engages in such a way that the planar surface of the metal plate 7 can contact in a planar fashion the likewise planar lower side of the horizontal branch 101 of the carrier element 10.

As an alternative to magnetic holding, a holder comprising a spring element or the like may for example be provided.

The LED lighting module 1 can therefore be electrically and mechanically connected particularly simply to the rest of the luminaire 9, or the carrier element 10. To this extent, the LED lighting module 1 forms a modular component, or an "LED light component".

In the example shown, the carrier element 10 of the luminaire 9 is configured to be longer than the LED lighting module 1 along the longitudinal axis L. In particular, the configuration is such that the luminaire 9 in total comprises a plurality of LED lighting modules 1, 1', for example of the same design, which are arranged in a row along the longitudinal axis L while respectively being held in a similar way on the carrier element 10 and being respectively connected electrically to a corresponding contacting element. FIG. 17 shows an end region of the luminaire 9 with the two LED lighting modules 1, 1'.

As shown by FIG. 18, in the example shown the luminaire 9 comprises for example fourteen LED lighting modules in total.

Furthermore, the LED lighting module 1 preferably also comprises electronic components for operation of the first LEDs 2 and the at least one second LED 4. The electronic components may in this case be arranged on the LED printed circuit board 6.

The LED lighting module 1 is preferably configured in such a way that the first LEDs 2 on the one hand, and the at least one second LED 4 on the other hand, can be driven independently of one another, and in particular can be switched and dimmed independently of one another. In this way, different lighting atmospheres can be generated in a versatile way with the luminaire. As already mentioned, the electrical connection between the LED lighting module 1 and the contacting element 11 is preferably such that control signals can also be transmitted by means of this. In the case of a corresponding plurality of contacting element, the latter are preferably electrically connected to one another while running along the upper side of the horizontal branch 101 of the carrier element 2, and are for example combined in order to form a cable harness.

An operating device for the LED lighting module 1, or for the LED lighting modules 1, 1", is preferably arranged on the carrier element 10 of the luminaire. The effect achievable in this way is that the weight and the overall size of the LED lighting module 1 can be kept small and handling is thus furthermore facilitated.

By virtue of its structure, the LED lighting module 1 is particularly suitable for being configured in different shapes and sizes. It is therefore suitable particularly for modular construction of a luminaire. In this case, the shape of the luminaire is not restricted to the elongate embodiment, or long-field luminaire, described above by way of example. As an alternative, the luminaire may for example have a rectangular or square or even round base shape. The luminaire is also not restricted to a hanging luminaire. As an alternative, it may for example be a luminaire fitted into or onto a ceiling, or a wall luminaire or a downlight or a standard luminaire. In the case of a ceiling or wall luminaire, the LED lighting module 1 is also particularly suitable as a single module. With the aid of the LED lighting module 1, very different luminaires can correspondingly be configured particularly suitably. In this case, the LED lighting module 1 can be produced particularly economically.

The structure of the luminaire allows particularly simple replacement of the LED lighting module 1. Provision may also be made for the luminaire to comprise a dummy piece or a sensor element, or even another element, instead of an LED lighting module 1.

The invention claimed is:

1. An LED lighting module, comprising a plurality of first LEDs for generating first light, a first optical element located adjacent the plurality of first LEDs for influencing the first light, the first optical element being configured to influence the first light in such that it is emitted collimated from the LED lighting module in a direction R, at least one second LED for generating a second light, and a second optical element located adjacent the second LED for influencing the second light, the second optical element being configured to influence the second light in such that it is emitted diffusely from the LED lighting module in a solid angle around the direction R, wherein the second optical element forms a U-shaped cross section channel extending adjacent to and around a periphery of a central region, the second optical element arranged inlaid in the first optical element.

2. The LED lighting module as claimed in claim 1, wherein the first LEDs and the at least one second LED are arranged in such a way that as observed counter to the direction R, the first LEDs are arranged in the central region and the at least one second LED is arranged in an outer region.

3. The LED lighting module as claimed in claim 2, wherein a plurality of second LEDs are at least two of the second LEDs being arranged on two opposite sides of the central region.

4. The LED lighting module as claimed in claim 1, wherein the at least one second LED comprises at least four second LEDs spaced around the central region.

5. The LED lighting module as claimed in claim 1, wherein the first LEDs and/or the at least one second LED are arranged in a matrix on the printed circuit board.

6. The LED lighting module as claimed in claim 1, wherein the first optical element comprises a plurality of lens elements and configured so that precisely one of the plurality of lens elements is assigned to each of the plurality of first LEDs.

7. The LED lighting module as claimed in claim 1, wherein the first optical element forms a first housing part of the LED lighting module.

8. The LED lighting module as claimed in claim 1, wherein the first optical element is configured to influence the first light so that it is emitted without glare from the LED lighting module.

9. The LED lighting module as claimed in claim 1, wherein the second optical element consists of an opal or colored plastic.

10. The LED lighting module as claimed in claim 1, wherein the second optical element comprises a structured surface region structured in a wave-like manner.

11. The LED lighting module as claimed in claim 10, wherein the structured surface region is configured in such a way that the second optical element has, in a subregion which is described by a projection of the at least one second LED in the direction R, a thickness which decreases from the subregion toward at least one side.

12. The LED lighting module as claimed in claim 1, furthermore comprising electronic components for operation of the first LEDs and of the at least one second LED.

13. The LED lighting module as claimed in claim 1, wherein the first LEDs, and the at least one second LED, can be driven independently of one another.

14. The LED lighting module as claimed in claim 7, wherein the plurality of first LEDs or the at least one second LED are arranged on a printed circuit board, the printed circuit board forms a second housing part of the LED lighting module.

15. The LED lighting module as claimed in claim 14, wherein the first optical element and the printed circuit board are connected to one another by a latch connection.

16. The LED lighting module as claimed in claim 1, furthermore comprising an aluminum plate, the first LEDs and the at least one second LED being arranged thermally conductively connected to the aluminum plate, the aluminum plate forming a second housing part of the LED lighting module.

17. The LED lighting module as claimed in claim 1, furthermore comprising a plug element for electrical connection between the first LEDs and the at least one second LED on the one hand, and a carrier element of a luminaire on the other hand.

18. A luminaire, comprising at least one LED lighting module as claimed in claim 1, wherein the luminaire comprises an operating device for the electricity supply of the at least one LED lighting module.

19. The LED lighting module as claimed in claim 4, wherein the central region extends along a longitudinal axis L and has a longitudinal length greater than a width, and wherein the U-shaped channel extends longitudinally along two opposite longitudinal sides of the central region.

* * * * *